US009696664B2

(12) United States Patent
Sakurai et al.

(10) Patent No.: US 9,696,664 B2
(45) Date of Patent: Jul. 4, 2017

(54) IMAGE FORMING APPARATUS, IMAGE FORMATION SYSTEM AND RECORDING MEDIUM

(71) Applicant: Konica Minolta, Inc., Chiyoda-ku, Tokyo (JP)

(72) Inventors: Shota Sakurai, Tokyo (JP); Tatsuya Furuta, Tokyo (JP); Natsuko Kawai, Tokyo (JP); Tetsuya Ishikawa, Kanagawa (JP); Tomohiro Kawasaki, Kanagawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/149,391

(22) Filed: May 9, 2016

(65) Prior Publication Data

US 2016/0342113 A1 Nov. 24, 2016

(30) Foreign Application Priority Data

May 19, 2015 (JP) ..... 2015-101921

(51) Int. Cl.
*G03G 15/16* (2006.01)
*G03G 15/00* (2006.01)

(52) U.S. Cl.
CPC ..... *G03G 15/161* (2013.01); *G03G 15/5058* (2013.01); *G03G 2215/00059* (2013.01); *G03G 2221/001* (2013.01)

(58) Field of Classification Search
CPC ..... G03G 15/161; G03G 15/5058
USPC ..... 399/71, 101
See application file for complete search history.

(56) References Cited

U.S. PATENT DOCUMENTS 8,660,446 B2 * 2/2014 Kakehi ..... G03G 15/161 399/49
8,818,217 B2 * 8/2014 Takayanagi ..... G03G 15/5058 399/101
2007/0230989 A1 10/2007 Maeda et al.
2012/0213546 A1 8/2012 Kawamata
2012/0301176 A1 11/2012 Ferrar et al.

FOREIGN PATENT DOCUMENTS

JP 2002-156838 A 5/2002

OTHER PUBLICATIONS

Extended European Search Report dated Oct. 12, 2016 for EP Application No. 16168933.6; 7 pages.

* cited by examiner

*Primary Examiner* — William J Royer
(74) *Attorney, Agent, or Firm* — Squire Patton Boggs (US)

(57) ABSTRACT

An image forming apparatus includes a second cleaning section, an image formation control section configured to control an image forming section to form a high-coverage patch on a transfer belt, and a cleaning control section configured to control the second cleaning section to perform cleaning of the patch on the transfer belt.

9 Claims, 15 Drawing Sheets

IMAGE FORMING APPARATUS, IMAGE FORMATION SYSTEM AND RECORDING MEDIUM

CROSS REFERENCE TO RELATED APPLICATIONS

This application is entitled to and claims the benefit of Japanese Patent Application No. 2015-101921, filed on May 19, 2015, the disclosure of which including the specification, drawings and abstract is incorporated herein by reference in its entirety.

1. Field of the Invention

The present invention relates to an electrophotographic image forming apparatus, an image formation system and a recording medium.

2. Description of Related Art

In general, an electrophotographic image forming apparatus (such as a printer, a copy machine, and a fax machine) is configured to irradiate (expose) a charged photoconductor (image bearing member) with (to) laser light based on image data to form an electrostatic latent image on the surface of the photoconductor. The electrostatic latent image is then visualized by supplying toner from a developing device to the photoconductor on which the electrostatic latent image is formed, whereby a toner image is formed. Further, the toner image is directly or indirectly transferred to a sheet, and thereafter fixed through heating and pressing at a fixing nip of a heating member (for example, a heating roller) and a pressing member (for example, a pressure roller), thereby forming an image on the sheet.

Conventionally, image formation systems have been practically used in which a sheet feeding apparatus that feeds a continuous sheet such as a continuous roll sheet is connected at the preceding side of the image forming apparatus, and a winding apparatus that winds up the sheet on which an image has been formed by the image forming apparatus is connected at the succeeding side of the image forming apparatus.

A scheme using an intermediate transfer belt is known as a scheme of an image forming apparatus for indirectly transferring a toner image formed on a photoconductor to a sheet. In the scheme using an intermediate transfer belt, toner that leaks during transfer of a toner image to a sheet may remain on the belt, and therefore a belt cleaning device for removing the remaining toner is provided. For example, the image forming apparatus disclosed in Japanese Patent Application Laid-Open No. 2002-156838 has two belt cleaning devices, and one of the devices is used in the normal operations whereas both devices are used in the case of a high coverage (high adhering amount) such as jam remainder/image patches for correction or the like.

In an electrophotographic image forming apparatus, outputting of a patch (belt-shaped image) is performed for the purpose of refreshing the toner in the developing device in order to prevent degradation of developer (powder composed of a mixture of toner and carrier of a magnetic substance) after operations of low coverage rate are successively performed. Typically, the outputting of the patch is performed at an interval between sheets in the case where a cut sheet is used, whereas the outputting is performed after the completion of the print job in the case where a roll sheet is used. The output patch is collected and cleaned up by a belt cleaning device of an intermediate transfer belt.

The patch can be formed at intervals of several seconds in the case where cut sheets are used; however, in the case where roll sheets are used, the patch is formed at one time after completion of the print job. For example, in the case where cut sheets are used, the patch images are formed six times in one minute when the patch is formed at intervals of 10 seconds. In the case where roll sheets are used, the patch is formed at one time after one minute has elapsed by an amount corresponding to the six patches of the case of cut sheets. When a patch is formed by an amount corresponding to the amount of six patches of the case of cut sheets, the time for outputting the patch is inevitably increased. That is, as the time period of the print job increases, the subsequent patch output time increases, and consequently, the waiting time of the user for the patch output increases.

In the case where roll sheets are used, the patch output time can be reduced by increasing the output amount (that is, by using high coverage patch); however, high cleaning performance is required to output a high-coverage patch. However, a belt cleaning device has a limit for cleaning performance, and therefore, outputting of a high-coverage patch exceeding such a limit is typically not performed.

The image forming apparatus disclosed in Japanese Patent Application Laid-Open No. 2002-156838 has two belt cleaning devices, but is not configured to output a high coverage (or super high-coverage) patch.

SUMMARY OF THE INVENTION

An object of the present invention is to provide an image forming apparatus, an image formation system and a recording medium which can perform toner refreshing in a short time without causing abrasion and turn-up of a blade of a belt cleaning device even when a roll sheet is used.

To achieve at least one of the abovementioned objects, an image forming apparatus reflecting one aspect of the present invention includes: a transfer belt; an image forming section configured to form a toner image on the transfer belt; a first cleaning section configured to perform cleaning for removing toner on the transfer belt; a second cleaning section having a cleaning performance greater than a cleaning performance of the first cleaning section, and configured to perform cleaning for removing the toner on the transfer belt at a position on an upstream side of the first cleaning section in a movement direction of the transfer belt; a determination section configured to determine a necessity of formation of a high-coverage patch having a coverage exceeding a limit of the cleaning performance of the first cleaning section on a basis of job information relating to a print job; an image formation control section configured to control the image forming section to form the high-coverage patch on the transfer belt when formation of the high-coverage patch is necessary; and a cleaning control section configured to control the second cleaning section to execute the cleaning at a time when the high-coverage patch on the transfer belt passes over a position of the second cleaning section.

Desirably, in the image forming apparatus, the job information used for determination of the determination section includes information on whether a sheet used in the print job is a continuous sheet, and information on whether a coverage rate in the print job is lower than a predetermined value.

Desirably, in the image forming apparatus, the high-coverage patch includes a high-coverage part having a coverage exceeding the limit of the cleaning performance of the first cleaning section, and a low-coverage part located at a front end and a rear end of the high-coverage part and having a coverage equal to or lower than the limit of the cleaning performance of the first cleaning section; and the cleaning control section starts the cleaning of the second cleaning section at a timing when the low-coverage part located at the front end passes over the position of the second cleaning section, and stops the cleaning of the second cleaning section at a timing when the low-coverage part located at the rear end passes over the position of the second cleaning section.

Desirably, in the image forming apparatus, each of the first cleaning section and the second cleaning section includes a blade, and the blade of the second cleaning section makes contact with the transfer belt with a contact angle and/or a contact force greater than a contact angle and/or a contact force of the blade of the first cleaning section.

Desirably, in the image forming apparatus, each of the first cleaning section and the second cleaning section includes a blade, and the blade of the second cleaning section has a width smaller than a width of the blade of the first cleaning section.

To achieve at least one of the abovementioned objects, an image formation system reflecting one aspect of the present invention includes: a sheet feeding apparatus configured to feed a roll sheet; the abovementioned image forming apparatus; and a winding apparatus configured to wind up the roll sheet on which the toner image is formed by the image forming apparatus.

To achieve at least one of the abovementioned objects, a non-transitory computer-readable recording medium storing a program of an image forming apparatus, the image forming apparatus including: a transfer belt; an image forming section configured to form a toner image on the transfer belt; a first cleaning section configured to perform cleaning for removing toner on the transfer belt; and a second cleaning section having a cleaning performance greater than a cleaning performance of the first cleaning section, and configured to perform cleaning for removing the toner on the transfer belt at a position on an upstream side of the first cleaning section in a movement direction of the transfer belt, the program being configured to cause a computer of the image forming apparatus to execute processing, the processing including: determining a necessity of formation of a high-coverage patch having a coverage exceeding a limit of the cleaning performance of the first cleaning section on a basis of job information relating to a print job; controlling the image forming section to form the high-coverage patch on the transfer belt when formation of the high-coverage patch is necessary; and controlling the second cleaning section to execute the cleaning at a time when the high-coverage patch on the transfer belt passes over a position of the second cleaning section.

Desirably, in the non-transitory computer-readable recording medium, the job information includes information on whether a sheet used in the print job is a continuous sheet, and information on whether a coverage rate in the print job is lower than a predetermined value.

Desirably, in the non-transitory computer-readable recording medium, the high-coverage patch includes a high-coverage part having a coverage exceeding the limit of the cleaning performance of the first cleaning section, and a low-coverage part located at a front end and a rear end of the high-coverage part and having a coverage equal to or lower than the limit of the cleaning performance of the first cleaning section; and the computer of the image forming apparatus is caused to execute processing including starting the cleaning of the second cleaning section at a timing when the low-coverage part located at the front end passes over the position of the second cleaning section, and stopping the cleaning of the second cleaning section at a timing when the low-coverage part located at the rear end passes over the position of the second cleaning section.

DESCRIPTION OF THE PREFERRED EMBODIMENTS

Figure 1:
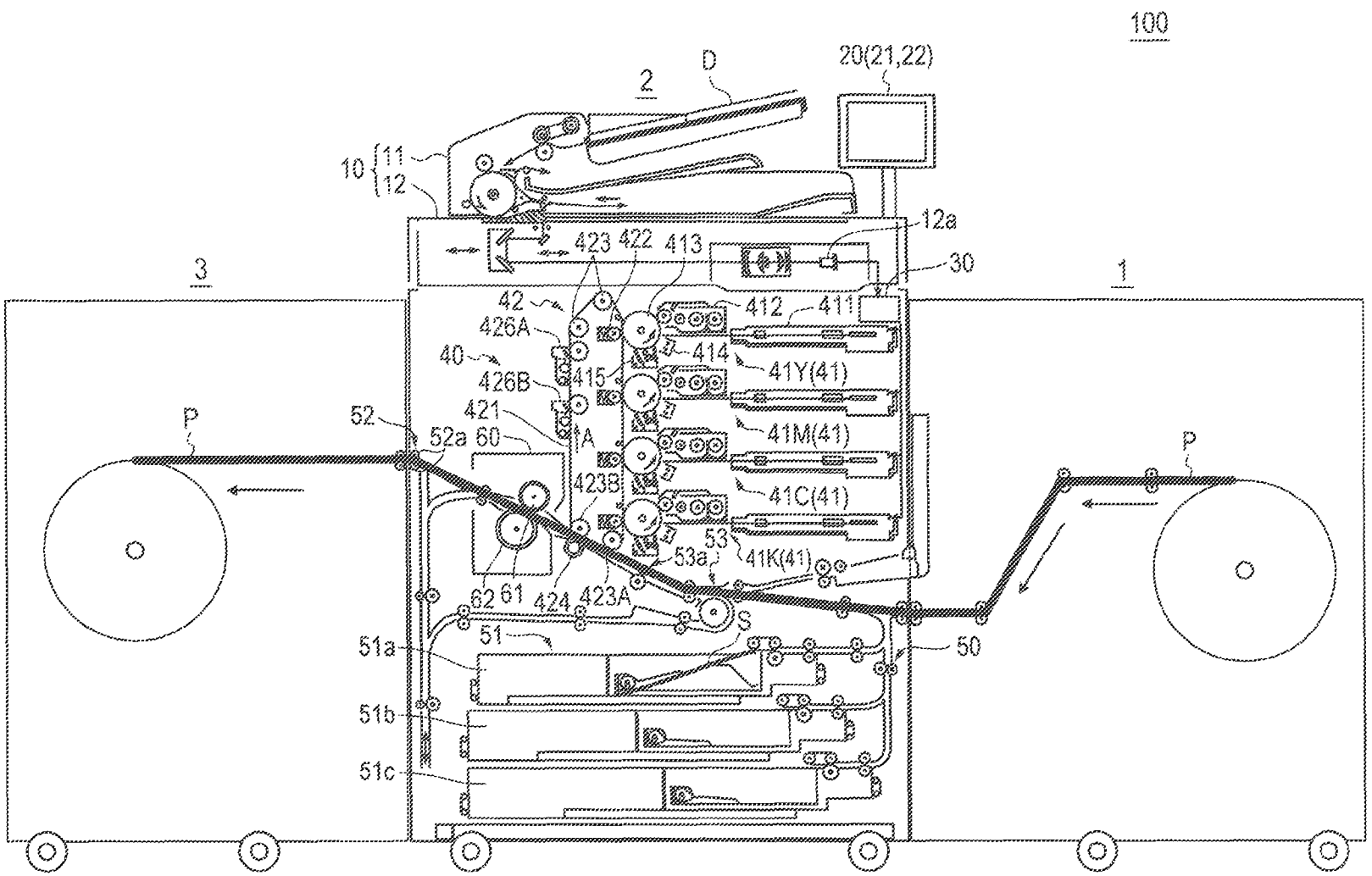
FIG. 1 schematically illustrates a general configuration of an image formation system according to an embodiment of the present invention.
Figure 2:
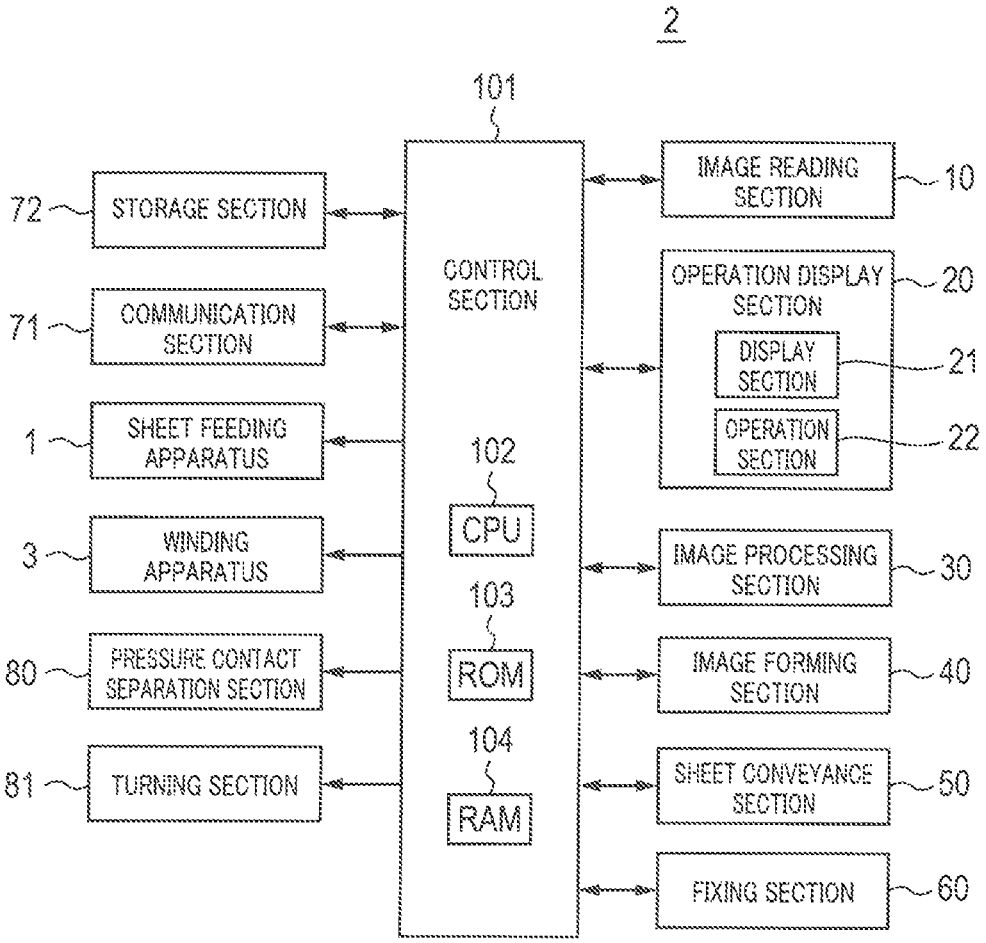
FIG. 2 illustrates a configuration of a principal part of a control system of an image forming apparatus of the embodiment.

In the following, the present embodiment is described in detail with reference to the drawings. FIG. 1 schematically illustrates a general configuration of image formation system 100 according to an embodiment of the present invention. FIG. 2 illustrates a configuration of a principal part of a control system of image forming apparatus 2 of image formation system 100 according to the present embodiment. Image formation system 100 is a system that uses roll sheet P indicated with the heavy line in FIG. 1, or sheets (hereinafter referred to as "cut sheet") S cut into a predetermined paper size as a recording medium, and forms an image on roll sheet P or cut sheet S.

As illustrated in FIG. 1, in image formation system 100, sheet feeding apparatus 1, image forming apparatus 2 and winding apparatus 3 are connected to each other from the upstream side in the conveyance direction of roll sheet P (hereinafter referred to also as "sheet conveyance direction"). Sheet feeding apparatus 1 and winding apparatus 3 are used when an image is formed on roll sheet P.

Sheet feeding apparatus 1 is an apparatus that feeds roll sheet P to image forming apparatus 2. As illustrated in FIG. 1, in the housing of sheet feeding apparatus 1, roll sheet P is wound around a support shaft and is rotatably held. Sheet feeding apparatus 1 conveys, via a plurality of conveyance roller pairs (for example, delivery rollers, sheet feed rollers and the like), roll sheet P wound around the support shaft to image forming apparatus 2 at a constant speed. The sheet feeding operation of sheet feeding apparatus 1 is controlled by control section 101 of image forming apparatus 2.

It is to be noted that the sheet fed from sheet feeding apparatus 1 may not be roll sheet P held in a roll form. Any sheet may be used as long as the sheet is a long continuous sheet as with roll sheet P, and the sheet may be held and housed in various manners.

Image forming apparatus 2 is a color-image forming apparatus of an intermediate transfer system using electrophotographic process technology. Specifically, image forming apparatus 2 primary-transfers toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 2 secondary-transfers the resultant image to roll sheet P fed from sheet feeding apparatus 1 or cut sheet S sent from sheet feed tray units 51*a* to 51*c*, to thereby form an image.

A longitudinal tandem system is adopted for image forming apparatus 2. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

As illustrated in FIG. 2, image forming apparatus 2 includes image reading section 10, operation display section 20, image processing section 30, image forming section 40, sheet conveyance section 50, fixing section 60, communication section 71, storage section 72, pressure contact separation section 80, turning section 81 and control section 101.

Control section 101 includes central processing unit (CPU) 102, read only memory (ROM) 103, random access memory (RAM) 104 and the like. CPU 102 reads out a program corresponding to processing details from ROM 103, loads the program in RAM 104, and performs a centralized control of operations of the blocks and the like of image forming apparatus 2 in conjunction with the loaded program. At this time, CPU 101 refers to various kinds of data stored in storage section 72. Storage section 72 is composed of, for example, a non-volatile semiconductor memory (so-called flash memory) or a hard disk drive.

Control section 101 transmits and receives various data to and from an external apparatus (for example, a personal computer) connected to a communication network such as a local area network (LAN) or a wide area network (WAN), through communication section 71. Control section 101 receives, for example, image data (input image data) transmitted from the external apparatus, and performs control to form an image on roll sheet P or cut sheet S on the basis of the image data. Communication section 71 is composed of, for example, a communication control card such as a LAN card. In addition, as described in detail later, control section 101 performs various controls for refreshing toner.

Image reading section 10 includes auto document feeder (ADF) 11, document image scanning device 12 (scanner), and the like. Auto document feeder 11 causes a conveyance mechanism to feed document D placed on a document tray, and sends out document D to document image scanning device 12. Auto document feeder 11 enables images (even both sides thereof) of a large number of documents D placed on the document tray to be successively read at once.

Document image scanning device 12 optically scans a document fed from auto document feeder 11 to its contact glass or a document placed on its contact glass, and images light reflected from the document Don the light receiving surface of charge coupled device (CCD) sensor 12*a*, to thereby read the document image. Image reading section 10 generates input image data on the basis of a reading result provided by document image scanning device 12. Image processing section 30 performs predetermined image processing on the input image data.

Operation display section 20 includes, for example, a liquid crystal display (LCD) provided with a touch panel, and functions as display section 21 and operation section 22. Display section 21 displays various operation screens, image conditions, operating statuses of functions, and the like in accordance with display control signals received from control section 101. Operation section 22 includes various operation keys such as numeric keys and a start key, receives various input operations performed by a user, and outputs operation signals to control section 101.

Image processing section 30 includes a circuit that performs a digital image process suited to initial settings or user settings on the input image data, and the like. For example, image processing section 30 performs tone correction on the basis of tone correction data (tone correction table), under the control of control section 101. In addition to the tone correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41Y, 41M, 41C, and 41K that form images of colored toners of a Y component, an M component, a C component, and a K component on the basis of the input image data; intermediate transfer unit 42; and the like.

Image forming units 41Y, 41M, 41C, and 41K for the Y component, the M component, the C component, and the K component have similar configurations. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposure device 411, developing device 412, photoconductor drum 413, charging device 414, drum cleaning device 415 and the like.

Photoconductor drum 413 is, for example, a negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) which is made of aluminum and has a diameter of 80 [mm]. The charge generation layer is made of an organic semiconductor in which a charge generating material (for example, phthalocyanine pigment) is dispersed in a resin binder (for example, polycarbonate), and generates a pair of positive charge and negative charge through light exposure by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 101 controls a driving current supplied to a driving motor (not shown in the drawings) that rotates photoconductor drums 413, whereby photoconductor drums 413 is rotated at a constant circumferential speed.

Charging device 414 evenly negatively charges the surface of photoconductor drum 413. Exposure device 411 is composed of, for example, a semiconductor laser, and configured to irradiate photoconductor drum 413 with laser light corresponding to the image of each color component. The positive charge is generated in the charge generation layer of photoconductor drum 413 and is transported to the surface of the charge transport layer, whereby the surface charge (negative charge) of photoconductor drum 413 is neutralized. An electrostatic latent image of each color component is formed on the surface of photoconductor drum 413 by the potential difference from its surroundings.

Developing device 412 is a developing device of a two-component developing type, and attaches toners of respective color components to the surface of photoconductor drums 413, and visualizes the electrostatic latent image to form a toner image.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning devices 426A and 426B, and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K-component is a driving roller. With this configuration, the travelling speed of the belt at a primary transfer section can be easily maintained at a constant speed. When driving roller 423A rotates, intermediate transfer belt 421 travels in arrow A direction at a constant speed.

Intermediate transfer belt 421 is a belt having conductivity and elasticity which includes on the surface thereof a high resistance layer having a volume resistivity of 8 to 11 [log Ω·cm]. Intermediate transfer belt 421 is rotationally driven by a control signal from control section 101. It is to be noted that the material, thickness and hardness of intermediate transfer belt 421 are not limited as long as intermediate transfer belt 421 has conductivity and elasticity.

Primary transfer rollers 422 are disposed on the inner periphery side of intermediate transfer belt 421 to face photoconductor drums 413 of respective color components. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face backup roller 423B disposed on the downstream side in the belt travelling direction relative to driving roller 423A, at a position on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to roll sheet P or cut sheet S is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when roll sheet P or cut sheet S passes through the secondary transfer nip, the toner image on intermediate transfer belt 421 is secondary-transferred to roll sheet P or cut sheet S. To be more specific, a secondary transfer bias is applied to secondary transfer roller 424, and an electric charge of the polarity opposite to the polarity of the toner is applied to the rear side (the side that makes contact with secondary transfer roller 424) of roll sheet P or cut sheet S, whereby the toner image is electrostatically transferred to roll sheet P or cut sheet S. Roll sheet P or cut sheet S on which the toner images have been transferred is conveyed toward fixing section 60. A configuration (so-called belt-type secondary transfer unit) in which a secondary transfer belt is installed in a stretched state in a loop form around a plurality of support rollers including a secondary transfer roller may also be adopted in place of secondary transfer roller 424.

Belt cleaning device 426A (first cleaning section) performs cleaning for removing the transfer residual toner remaining on the surface of intermediate transfer belt 421 after the secondary transfer. Belt cleaning device 426B (second cleaning section) is disposed on the upstream side of belt cleaning device 426A in the belt travelling direction, and performs cleaning for removing a high-coverage patch formed on intermediate transfer belt 421 during toner refreshing in each color developing device 412. Details of belt cleaning devices 426A and 426B, and the high-coverage patch will be described later.

Fixing section 60 applies heat and pressure to roll sheet P or cut sheet S conveyed thereto on which a toner image has been transferred to fix the toner image on roll sheet P or cut sheet S. In fixing section 60, fixing roller 61 serving as a fixing side member is disposed on a side of the surface of roll sheet P or cut sheet S on which a toner image is formed, and pressure roller 62 serving as a rear side supporting member is disposed on a side of the rear surface of roll sheet P or cut sheet S (the surface opposite to the fixation surface). Pressure roller 62 is brought into pressure contact with fixing roller 61 by a predetermined fixing load (for example, 1000 [N]). When pressure roller 62 makes pressure contact with fixing roller 61, a fixing nip for conveying roll sheet P or cut sheet S in a tightly sandwiching manner is formed between fixing roller 61 and pressure roller 62. Fixing roller 61 incorporates a heating source (halogen heater), and fixing roller 61 is heated with the heating source. Fixing roller 61 makes contact with roll sheet P or cut sheet S on which a toner image is formed, and thermally fixes the toner image on roll sheet P or cut sheet S at a fixation temperature (for example, 160 to 200[° C.]).

Sheet conveyance section 50 includes sheet feeding section 51, sheet ejection section 52, conveyance path section 53 and the like. Three sheet feed tray units 51*a* to 51*c* included in sheet feeding section 51 store cut sheets S (standard sheets, special sheets) discriminated on the basis of the basis weight, the size, and the like, for each type set in advance. Conveyance path section 53 has a plurality of pairs of conveyance rollers including a pair of registration rollers 53*a*. A registration roller section in which registration roller pair 53*a* is arranged corrects skew and displacement of cut sheet S or roll sheet P.

Sheets S stored in sheet tray units 51*a* to 51*c* are output one by one from the uppermost, and conveyed to image forming section 40 by conveyance path section 53. In image forming section 40, the toner image on intermediate transfer belt 421 is secondary-transferred to one side of cut sheet S at one time, and a fixing process is performed in fixing section 60. In addition, roll sheet P fed from sheet feeding apparatus 1 to image forming apparatus 2 is conveyed to image forming section 40 through conveyance path section 53. Then, in image forming section 40, the toner image on intermediate transfer belt 421 is secondary-transferred to one side of roll sheet P at one time, and a fixing process is performed in fixing section 60. Roll sheet P or cut sheet S on which an image has been formed is conveyed to winding apparatus 3 by sheet ejection section 52 having conveyance roller pair (sheet ejection roller pair) 52*a*.

Winding apparatus 3 is an apparatus for winding up and housing roll sheet P conveyed from image forming apparatus 2. As illustrated in FIG. 1, in the housing of winding apparatus 3, roll sheet P is wound around a support shaft and held in a roll form for example. As such, winding apparatus 3 winds up roll sheet P conveyed from image forming apparatus 2 around the support shaft at a constant speed via a plurality of conveyance roller pairs (for example, delivery rollers and sheet ejection rollers). The winding operation of winding apparatus 3 is controlled by control section 101 of image forming apparatus 2.

In this manner, roll sheet P fed from sheet feeding apparatus 1 to image forming apparatus 2 is conveyed to image forming section 40 through conveyance path section 53. Then, in image forming section 40, a toner image is transferred onto one surface of roll sheet P at one time, and thereafter, a fixation process is performed in fixing section 60. In addition, cut sheet S stored in sheet feeding section 51 is conveyed to image forming section 40 through conveyance path section 53. Then, in image forming section 40, a toner image is transferred onto one surface of cut sheet S at one time, and thereafter, a fixation process is performed in fixing section 60.

Next, belt cleaning devices 426A and 426B and a high-coverage patch are described in detail.

First, belt cleaning devices 426A and 426B are described.

Figure 3:
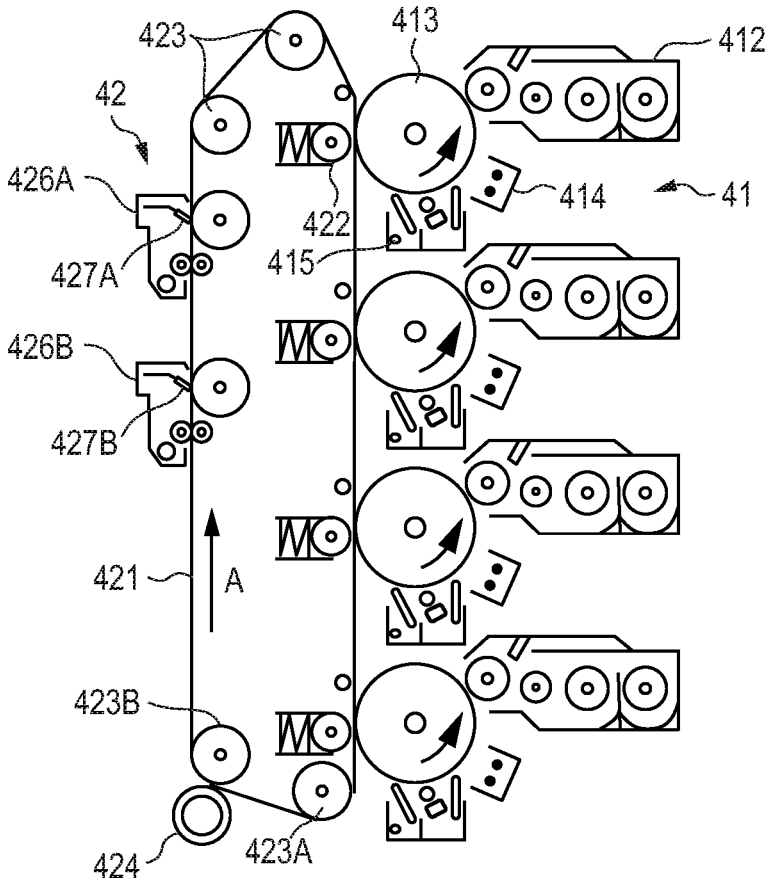
FIG. 3 is a part of an image forming unit and an intermediate transfer unit of the image forming apparatus of the embodiment.

FIG. 3 illustrates a part of image forming unit 41 and intermediate transfer unit 42. In FIG. 3, belt cleaning device 426A has blade 427A, and belt cleaning device 426B has blade 427B. In particular, blade 427B of belt cleaning device 426B makes pressure contact with intermediate transfer belt 421 with a contact angle and a contact force greater than those of blade 427A of belt cleaning device 426A.

Figure 4:
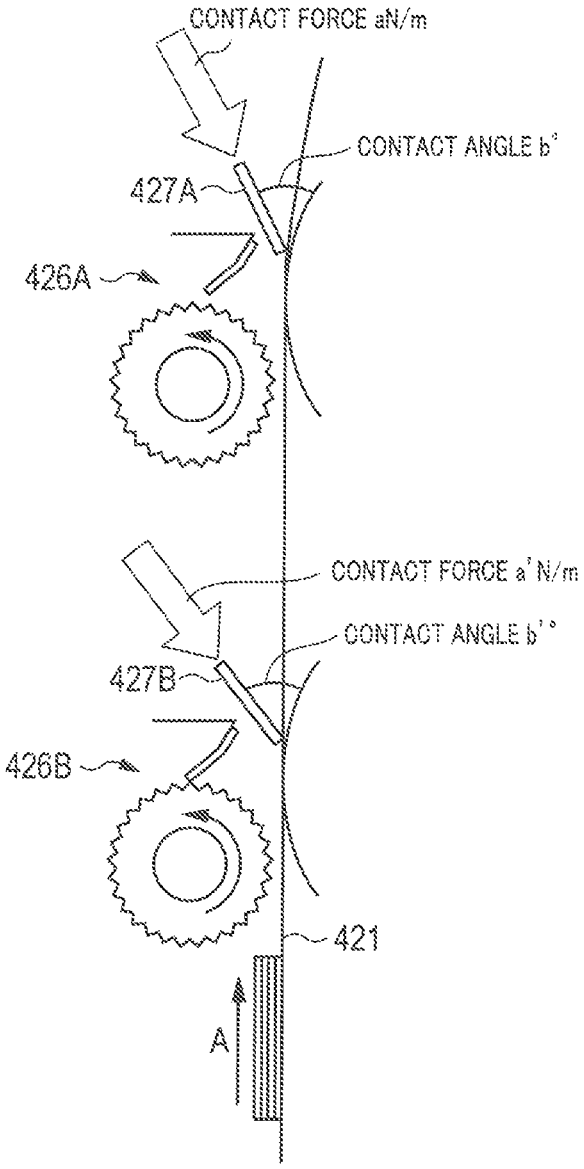
FIG. 4 schematically illustrates a state where blades of two belt cleaning devices make contact with an intermediate transfer belt of the image forming apparatus of the embodiment.

FIG. 4 schematically illustrates a state where blades 427A and 427B make contact with intermediate transfer belt 421. As illustrated in FIG. 4, blade 427A makes pressure contact with intermediate transfer belt 421 with contact force aN/m and contact angle b°, and blade 427B makes pressure contact with intermediate transfer belt 421 with contact force a'N/m and contact angle b'°. The contact force and the contact angle of blades 427A and 427B have a relationship of a'>a, b'>b. It should be noted that, when the contact force and the contact angle of blade 427B are excessively large or small, cleaning performance may not be ensured, and turn-up may be caused. In view of this, blade 427B is used in a predetermined range.

Figure 5:
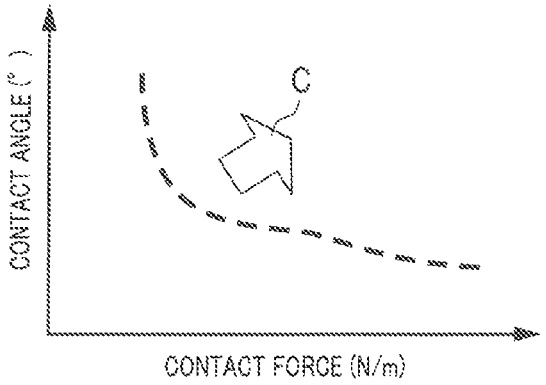
FIG. 5 shows a condition of a cleaning performance in the belt cleaning device.
Figure 6:
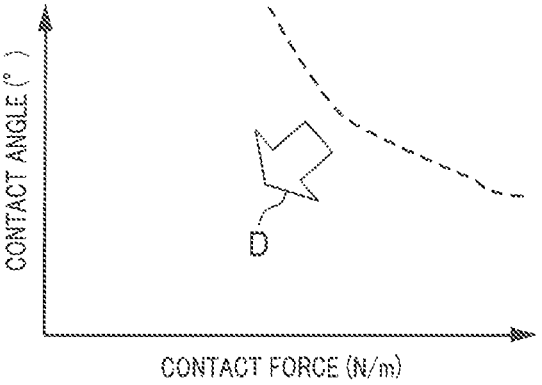
FIG. 6 shows a condition of turn-up of the blade in the belt cleaning device.

FIG. 5 shows a condition of cleaning performance, and the abscissa and the ordinate indicate contact force (N/m) and contact angle (°), respectively. In FIG. 5, the region indicated with arrow C is the region where cleaning performance can be ensured. On the other hand, FIG. 6 shows a condition of turn-up of the blade, and the abscissa and the ordinate indicate contact force (N/m) and contact angle (°), respectively. In FIG. 6, the region indicated with arrow D is the region where turn-up of the blade is not caused. The contact force and the contact angle of blade 427B are determined within the ranges indicated in FIG. 5 and FIG. 6.

Figure 7:
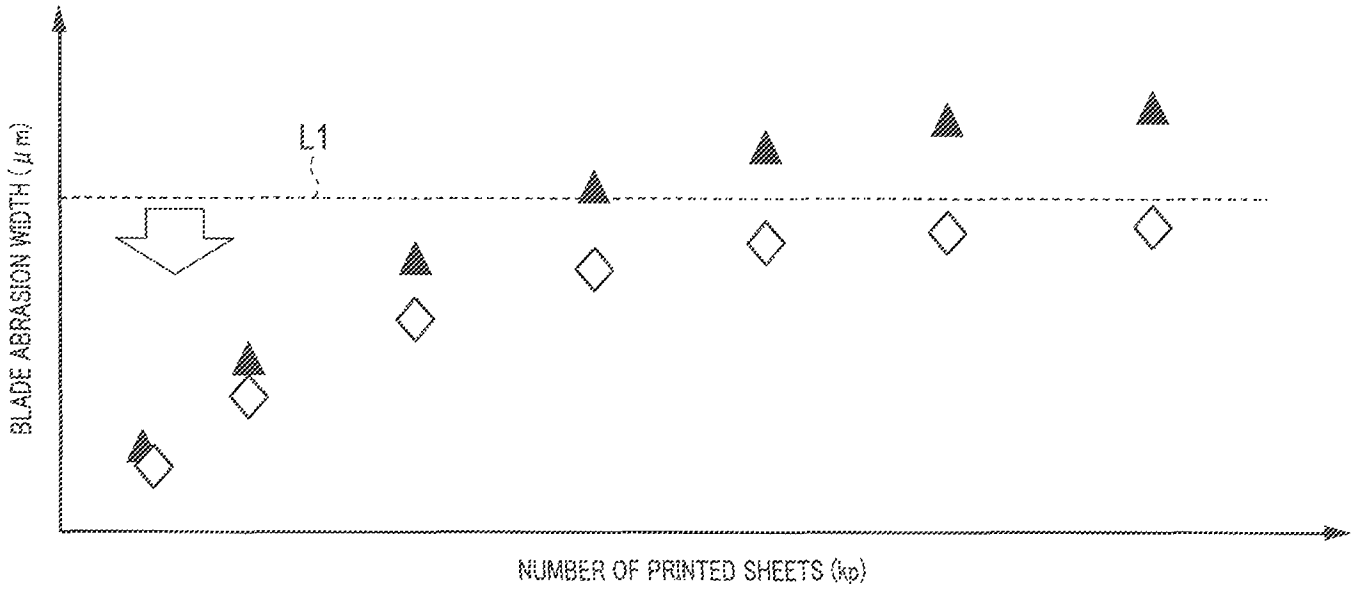
FIG. 7 shows transition of abrasion of a common blade in the belt cleaning device.

FIG. 7 shows common transition of abrasion of a blade of a belt cleaning device. The abscissa indicates the number of printed sheets (kp), and the ordinate indicates the blade abrasion width (μm). In FIG. 7, the transition of abrasion indicated with the rhombus corresponds to a case of the current contact angle, and the transition of abrasion indicated with the triangle corresponds to a case where the contact angle is set to +4°. The amount of abrasion is large when the contact angle is set to +4°, and therefore, when belt cleaning device 426B is used, an operation for pressure contact and separation with respect to intermediate transfer belt 421 is required. L1 in FIG. 7 is a functional target line, and cleaning device 426B can be used without the operation for pressure contact and separation in a range smaller than functional target line L1.

It is to be noted that, the relationships of the contact force and the contact angle of blades 427A and 427B may not be simultaneously satisfied, and it suffices that one of the relationships is satisfied as long as a cleaning performance greater than that of belt cleaning device 426A is obtained. That is, it suffices that at least one of a'>a and b'>b is satisfied. When blade 427B of belt cleaning device 426B makes pressure contact with intermediate transfer belt 421 with a contact angle and/or a contact force greater than a contact angle and/or a contact force of blade 427A of belt cleaning device 426A, a cleaning performance greater than belt cleaning device 426A is obtained.

Figure 8:
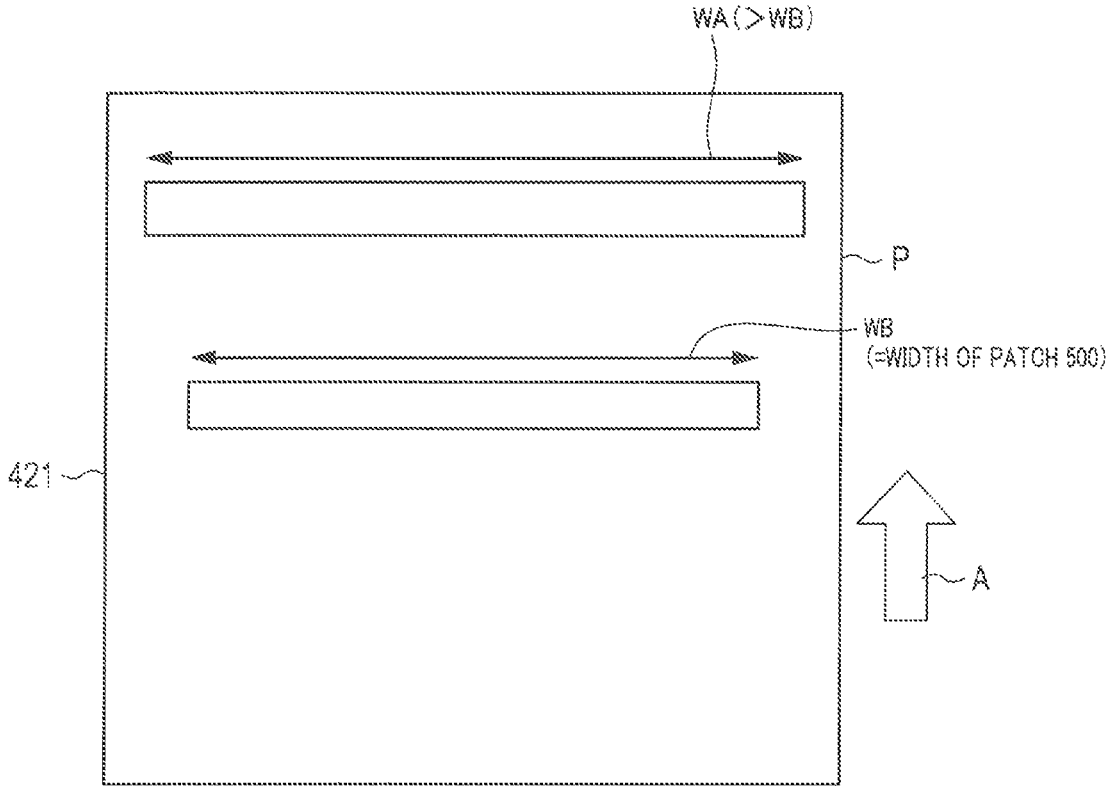
FIG. 8 illustrates widths of blades of the two belt cleaning devices.

The width of blade 427B of belt cleaning device 426B is smaller than the width of blade 427A of belt cleaning device 426A. FIG. 8 illustrates width WA of blade 427A of belt cleaning device 426A and width WB of blade 427B of belt cleaning device 426B. As illustrated in FIG. 8, width WB of blade 427B is smaller than width WA of blade 427A. Belt cleaning device 426B is provided to remove high-coverage patch 500 formed on intermediate transfer belt 421, and therefore width WB of blade 427B is set to coincide with the width of patch 500. It is to be noted that width WB of blade 427B of belt cleaning device 426B may be greater than the width of patch 500. However, since blade 427B of belt cleaning device 426B makes pressure contact with intermediate transfer belt 421 with a contact angle and/or a contact force greater than a contact angle and/or a contact force of blade 427A of belt cleaning device 426A, it can be said that a width approximately equal to the width of patch 500 is preferable from a view point of minimizing the influence on intermediate transfer belt 421. It is to be noted that arrow A in FIG. 8 indicates the travelling direction of intermediate transfer belt 421.

As described above, belt cleaning device 426B is configured to remove high-coverage patch 500 formed on intermediate transfer belt 421 at the time of toner refreshing in each color developing device 412. As such, belt cleaning device 426B is not always in contact with intermediate transfer belt 421, and makes pressure contact with intermediate transfer belt 421 only when patch 500 reaches thereto. Belt cleaning device 426B is brought into pressure contact with intermediate transfer belt 421 and separated from intermediate transfer belt 421 by turning section 81 (see FIG. 2). That is, turning section 81 brings belt cleaning device 426B into pressure contact with intermediate transfer belt 421 or separates belt cleaning device 426B from intermediate transfer belt 421.

Figure 9B:
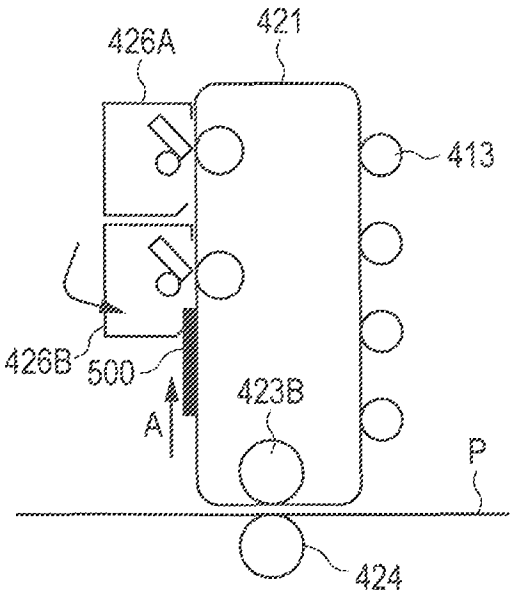
FIG. 9A and FIG. 9B illustrate a turning state of the belt cleaning device.
Figure 9A:
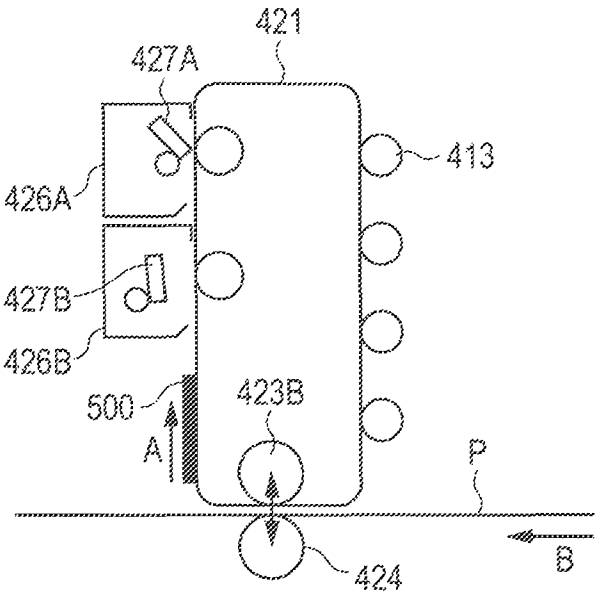

FIG. 9A and FIG. 9B illustrate a turning state of belt cleaning device 426B. As illustrated in FIG. 9A, belt cleaning device 426B is separated from intermediate transfer belt 421 until patch 500 arrives at a position immediately before belt cleaning device 426B, and when patch 500 arrives at a position immediately before belt cleaning device 426B, belt cleaning device 426B makes pressure contact with intermediate transfer belt 421 as illustrated in FIG. 9B. It is to be noted that formation of patch 500 is performed at a timing corresponding to the intervals between sheets in the case where cut sheet S is used, whereas formation of patch 500 is performed after the print job is terminated in the case where roll sheet P is used. In particular, in the case where roll sheet P is used, the roll sheet is present between intermediate transfer belt 421 and secondary transfer roller 424 at all times, and consequently patch 500 is transferred to roll sheet P. In view of this, in the case where roll sheet P is used, the pressure contact of secondary transfer roller 424 on backup roller 423B is released (that is, the secondary transfer nip is released) to separate roll sheet P from intermediate transfer belt 421. When the pressure contact state of secondary transfer roller 424 on backup roller 423B is released by pressure contact separation section 80 (see FIG. 2), secondary transfer roller 424 is separated from intermediate transfer belt 421. With this mechanism, patch 500 can be formed and patch 500 can be removed by belt cleaning device 426B even when roll sheet P is used.

Next, a high-coverage patch is described.

Figure 10A:
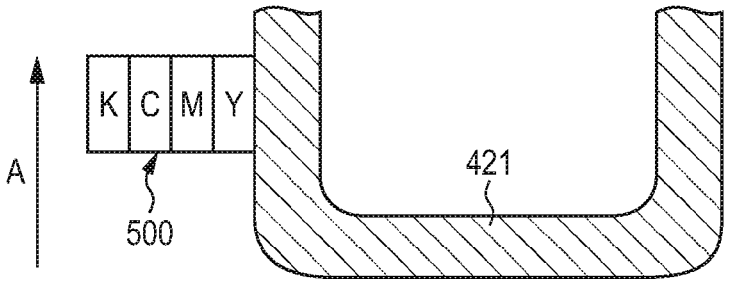
FIG. 10A illustrates a structure of a patch formed by the image forming apparatus of the present embodiment.
Figure 10B:
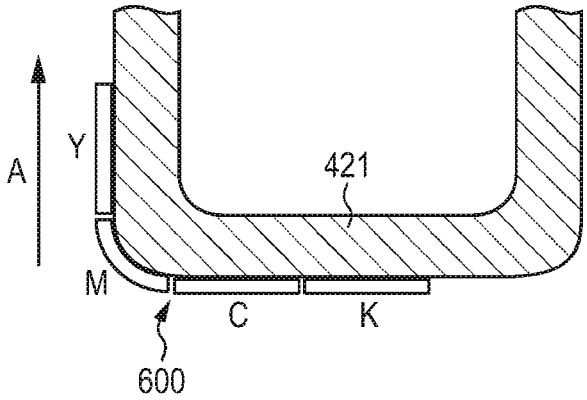
Prior Art FIG. 10B
FIG. 10B illustrates a structure of a patch formed by a conventional image forming apparatus.

FIG. 10A illustrates a structure of patch 500 formed in image forming apparatus 2 of the present embodiment, and FIG. 10B illustrates a structure of patch 600 formed in a conventional image forming apparatus. Patch 500 illustrated in FIG. 10A has a lamination structure of solid images of four colors of YMCK, and conventional patch 600 illustrated in FIG. 10B has a structure of solid images of four colors of YMCK arranged along intermediate transfer belt 421. The adhering amount of patch 500 is greater than that of patch 600. Conventionally, limitation has been imposed on the adhering amount to the intermediate transfer belt 421 from the viewpoint of fixation performance; however, since the patch is removed by the belt cleaning device without being transferred to the sheet, the limitation on the adhering amount can be eliminated. Therefore, a solid image of 400% of four colors of YMCK (400% of four colors is obtained with 100% image of each color) can be formed as a patch. When it is assumed that conventional patch 600 is a 7.5% image and that removal of the patch 600 with use of a belt cleaning device takes approximately 120 seconds, a simple calculation shows that removal of a 400% solid image takes approximately 2 seconds.

Control section 101 determines whether toner refreshing is required to be performed on the basis of the history of the coverage rate which is job information relating to the print job. When it is determined that toner refreshing is required, high-coverage patch 500 is formed with toner output from developing devices 412 of four colors, and is removed with belt cleaning device 426B. That is, when it is determined from the history of the coverage rate that formation of patch 500 is required, control section 101 calculates the toner amount required for formation of patch 500, and determines a patch output image. Then, when the currently used sheet is cut sheet S, control section 101 transfers patch 500 onto intermediate transfer belt 421 at intervals between sheets. After patch 500 is transferred onto intermediate transfer belt 421, turning section 81 is operated at the timing when patch 500 arrives at belt cleaning device 426B such that blade 427B of belt cleaning device 426B makes pressure contact with intermediate transfer belt 421.

When patch 500 arrives at the timing when blade 427B of belt cleaning device 426B makes pressure contact with intermediate transfer belt 421, blade 427B makes contact with patch 500. From that time point, patch 500 is scraped along with the movement of intermediate transfer belt 421. In the case where the currently used sheet is roll sheet P, control section 101 releases the secondary transfer nip and separates roll sheet P from intermediate transfer belt 421 after completion of the print job, and then, control section 101 transfers patch 500 to intermediate transfer belt 421. Thereafter, a control similar to the above-mentioned control is performed. It is to be noted that whether to perform the toner refreshing may be determined on the basis of the history of input image data as well as the coverage rate.

Figure 11:
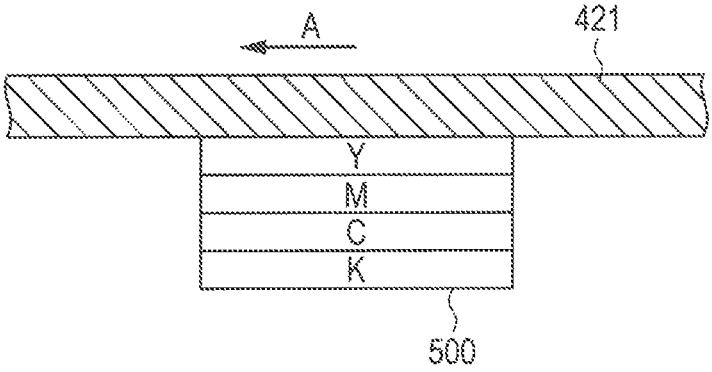
FIG. 11 illustrates a high-coverage patch transferred on an intermediate transfer belt.
Figure 12B:
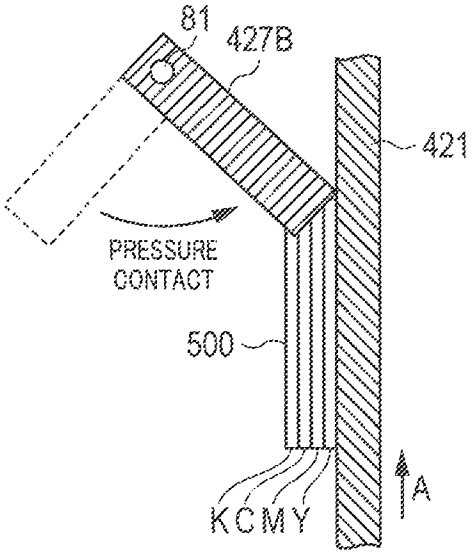
FIG. 12B illustrates a state of the blade after a patch arrives at the belt cleaning device.
Figure 12A:
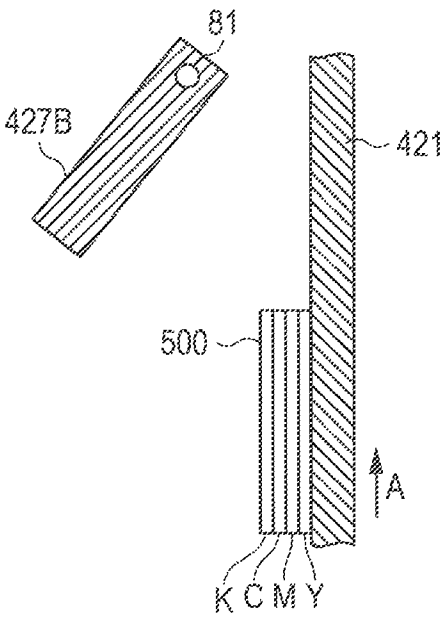
FIG. 12A illustrates a state of the blade before a patch arrives at the belt cleaning device.

FIG. 11 illustrates patch 500 transferred on intermediate transfer belt 421. In addition, FIG. 12A illustrates a state of blade 427B when patch 500 has not arrived at belt cleaning device 426B, and FIG. 12B illustrates a state of blade 427B when patch 500 has arrived at belt cleaning device 426B. As illustrated in FIG. 12A, belt cleaning device 426B is separated from intermediate transfer belt 421 when patch 500 has not arrived, and, at the timing when patch 500 arrives, belt cleaning device 426B turns to intermediate transfer belt 421 side to bring blade 427B into pressure contact with intermediate transfer belt 421 as illustrated in FIG. 12B. Patch 500 is conveyed thereto at the timing of pressure contact to intermediate transfer belt 421, and thus blade 427B makes contact with an end of patch 500.

Figure 13:
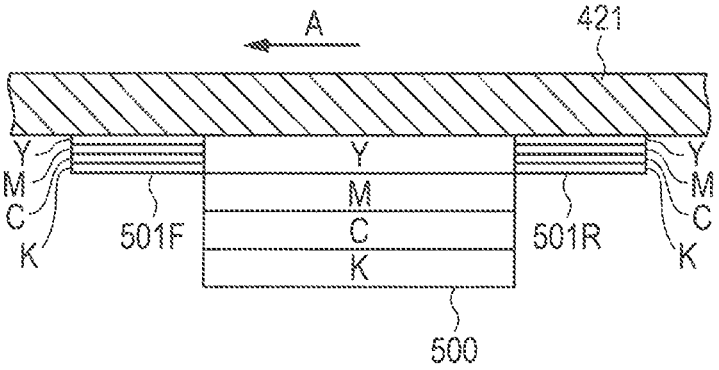
FIG. 13 illustrates a high-coverage patch and low coverage patches formed at front and rear of the high-coverage patch which are transferred on the intermediate transfer belt.

In the case where only high-coverage patch 500 illustrated in FIG. 11 is formed, highly accurate adjustment of the timing is required in order that blade 427B of belt cleaning device 426B surely makes contact with an end of patch 500. Slipping of the patch may be caused when the pressure contact timing is too early, and turn-up may be caused when the timing is too late. In particular, when slipping of high-coverage patch 500 is caused, the slipped patch cannot be removed by belt cleaning device 426A. In view of this, low coverage patches 501F and 501R are formed at front and rear of high-coverage patch 500 as illustrated in FIG. 13, whereby blade 427B of belt cleaning device 426B makes contact with low coverage patches 501F and 501R even when the timing when belt cleaning device 426B makes pressure contact with intermediate transfer belt 421 is shifted, and partial slipping of patch 500 and turn-up of blade 427B can be prevented.

Figures 14A, 14B, 14C:
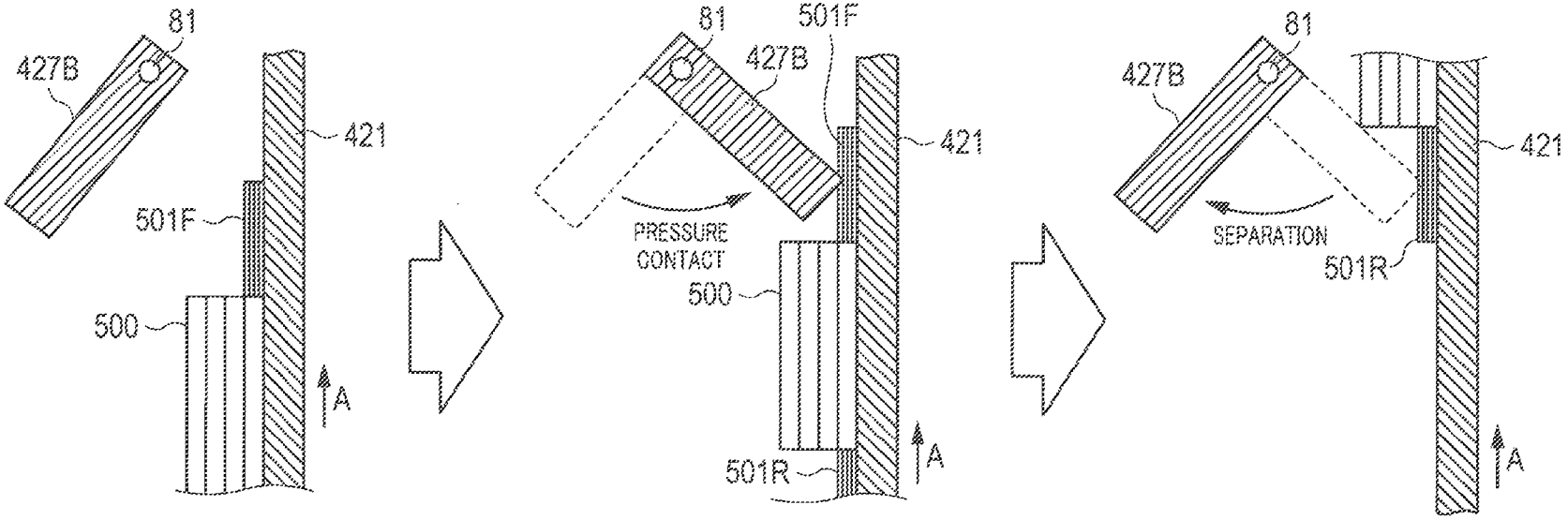
FIG. 14A illustrates a state of the blade before the patch provided with low coverage patches formed at front and rear thereof arrives at the belt cleaning device.
FIG. 14B illustrates a state of the blade after the patch provided with low coverage patches formed at front and rear thereof at the time when the patch arrives at the belt cleaning device.
FIG. 14C illustrates a state of the blade after the patch provided with low coverage patches formed at front and rear thereof has arrived at the belt cleaning device.

FIG. 14A illustrates a state of blade 427B before patch 500 having low coverage patches 501F and 501R formed at front and rear parts thereof arrives at belt cleaning device 426B. FIG. 14B illustrates a state of blade 427B at the time when patch 500 having low coverage patches 501F and 501R formed at front and rear parts thereof arrives at belt cleaning device 426B. FIG. 14C illustrates a state of blade 427B after patch 500 having low coverage patches 501F and 501R formed at front and rear parts thereof has arrived at belt cleaning device 426B. As illustrated in FIG. 14A, belt cleaning device 426B is separated from intermediate transfer belt 421 when patch 500 has not arrived, and, at the timing of arrival of patch 500, belt cleaning device 426B turns to intermediate transfer belt 421 side to bring blade 427B into pressure contact with intermediate transfer belt 421. At this time, when the timing of arrival of patch 500 is too late (or conversely, when the timing of starting the turning of belt cleaning device 426B is too early), blade 427B makes contact with patch 501F at the front of patch 500 as illustrated in FIG. 14B. When blade 427B makes contact with patch 501F, turn-up of blade 427B is not caused. In FIG. 14B, blade 427B is in contact with patch 501F at substantially the center portion thereof, and consequently the patch preceding substantially the center portion slips through the blade. However, the slipped patch is removed by belt cleaning device 426A, and therefore there is no problem.

At the timing when high-coverage patch 500 is removed by blade 427B of belt cleaning device 426B and the removal is completed, belt cleaning device 426B starts to turn to return to the original position. At this time, when the timing of starting the turning for resetting belt cleaning device 426B to the original position is too late, blade 427B also makes contact with patch 501R at the rear of patch 500 as illustrated in FIG. 14C. When blade 427B makes contact with patch 501R, turn-up of blade 427B is not caused.

As described, by forming low coverage patches 501F and 501R at front and rear of high-coverage patch 500, partial slipping of patch 500 and turn-up of blade 427B can be prevented even when the timing of turning of belt cleaning device 426B and the timing of arrival of patch 500 are shifted. In addition, when low coverage patches 501F and 501R are slipped, the slipped portion can be removed by belt cleaning device 426A.

Figure 15:
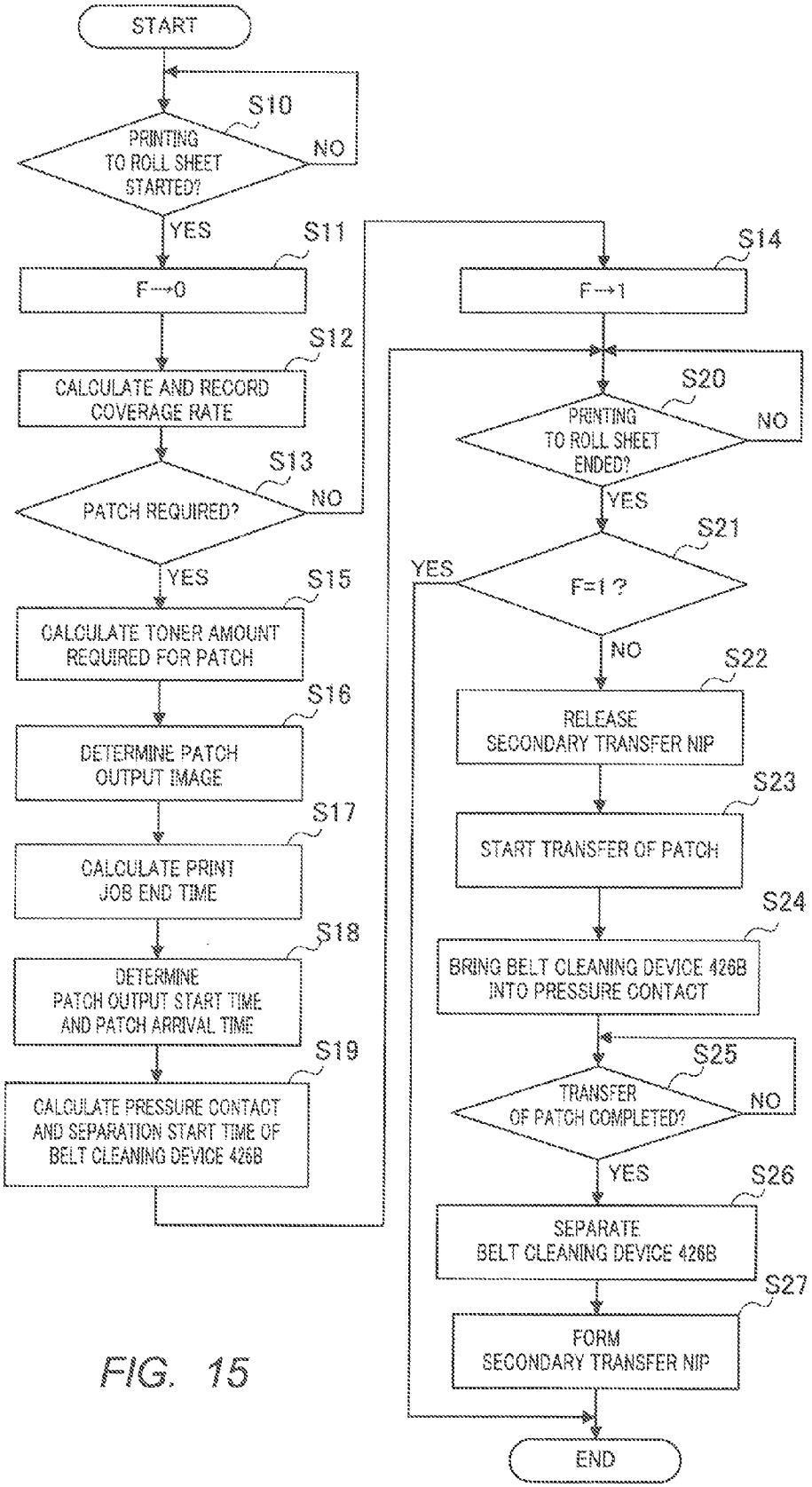
FIG. 15 is a flowchart of printing and toner refreshing in the case where a roll sheet is used.

FIG. 15 is a flowchart for describing printing and a toner refreshing process in the case where roll sheet P is used as the sheet. In FIG. 15, first, control section 101 determines whether printing to roll sheet P has been started (step S10). That is, whether an operation for starting printing has been performed at operation section 22 is determined. When it is determined that an operation for starting printing is not performed ("NO" at step S10), the determination of this step is repeated until an operation for starting printing is performed. When it is determined that an operation for starting printing is performed ("YES" at step S10), flag F is set to "0" (step S11), and thereafter, on the basis of the input image data, a coverage rate is calculated and recorded (step S12).

Next, control section 101 determines whether high-coverage patch 500 is required on the basis of the history of the coverage rate (step S13). When it is determined that high-coverage patch 500 is not required ("NO" at step S13), flag F is updated from "0" to "1" (step S14). When it is determined that high-coverage patch 500 is required ("YES" at step S13), a toner amount required for patch 500 is calculated (step S15). Next, a patch output image is determined from the calculated toner amount (step S16). For example, the patch output image is set to a solid image of four colors of YMCK illustrated in FIG. 11.

After the patch output image is determined, control section 101 calculates a print job end time (step S17). Next, a patch output start time and a patch arrival time are determined (step S18). Further, a start time of pressure contact and separation of belt cleaning device 426B is calculated (step S19). Next, control section 101 determines whether printing to roll sheet P has been completed (step S20). When it is determined that printing to roll sheet P has not been completed ("NO" at step S20), the determination of this step is repeated until printing is determined to be completed. When it is determined that printing has been completed ("YES" at step S20), whether the value of flag F is "1" is determined (step S21).

When it is determined that the value of flag F is "1" ("YES" at step S21), patch 500 is unnecessary, and therefore the processing is terminated without performing the processes of steps S22 to S26 described below (a process of releasing the secondary transfer nip, a process of transferring patch 500 to intermediate transfer belt 421, and a process for pressure contact and separation of belt cleaning device 426B with respect to intermediate transfer belt 421). In contrast, when it is determined that the value of flag F is not "1" ("NO" at step S21), pressure contact separation section 80 is controlled to release the secondary transfer nip (the pressure contact of secondary transfer roller 424 to backup roller 423B is released), and roll sheet P is separated from intermediate transfer belt 421 (step S22).

After secondary transfer nip is released and roll sheet P is separated from intermediate transfer belt 421, transfer of patch 500 to intermediate transfer belt 421 is started (step S23). Next, control section 101 controls turning section 81 to turn belt cleaning device 426B at the timing when patch 500 arrives at belt cleaning device 426B so that patch 500 is brought into pressure contact with intermediate transfer unit 421 (step S24).

Next, control section 101 determines whether patch 500 has been completely transferred to intermediate transfer unit 421 (step S25). When it is determined that patch 500 is not completely transferred to intermediate transfer unit 421 ("NO" at step S25), the determination of this step is repeated until the transfer is determined to be completed. In contrast, when it is determined that transfer of patch 500 to intermediate transfer unit 421 has been completed ("YES" at step S25), control section 101 controls turning section 81 to turn belt cleaning device 426B and separate belt cleaning device 426B from intermediate transfer unit 421 (step S26). After belt cleaning device 426B is separated from intermediate transfer unit 421, the secondary transfer nip is formed (step S27). That is, secondary transfer roller 424 is brought into pressure contact with backup roller 423B. After the secondary transfer nip is formed, the processing is terminated.

According to the embodiment having the above-mentioned configuration, belt cleaning device 426B which is disposed on the upstream side of belt cleaning device 426A in the movement direction of intermediate transfer belt 421 and has a cleaning performance greater than that of belt cleaning device 426A is provided as well as belt cleaning device 426A for removing low coverage patch 600, and, in the case where high-coverage patch 500 having a coverage exceeding the limit of the cleaning performance of belt cleaning device 426A is required to be formed, high-coverage patch 500 is formed on intermediate transfer unit 421, and cleaning is performed at the time when the high-coverage patch formed on intermediate transfer belt 421 passes over the position of belt cleaning device 426B.

Consequently, refreshing of toner can be performed in a short time without causing abrasion and turn-up of blade 427B of belt cleaning device 426B.

It should be understood by those skilled in the art that various modifications, combinations, sub-combinations and alterations may occur depending on design requirements and other factors in so far as they are within the scope of the appended claims or the equivalents thereof. While the invention made by the present inventor has been specifically described based on the preferred embodiments, it is not intended to limit the present invention to the above-mentioned preferred embodiments but the present invention may be further modified within the scope and spirit of the invention defined by the appended claims.

Figure 16A:
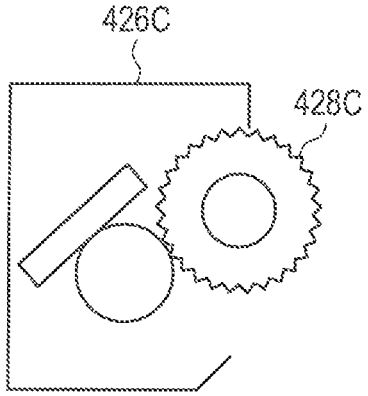
FIG. 16A illustrates a belt cleaning device using a brush cleaning scheme.
Figure 16B:
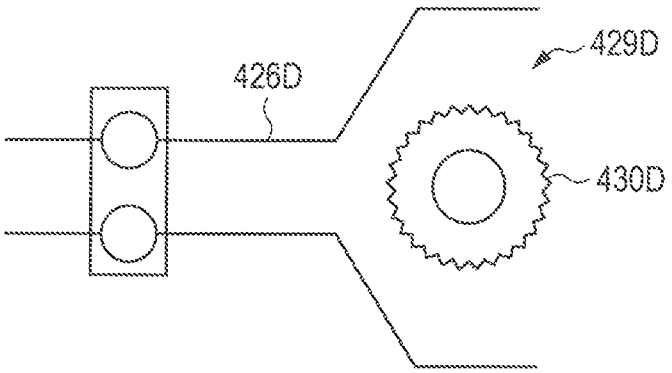
FIG. 16B illustrates a belt cleaning device using a suction scheme.

For example, as well as the blade type belt cleaning device 426B, brush cleaning type belt cleaning device 426C illustrated in FIG. 16A and suction type belt cleaning device 426D illustrated in FIG. 16B may also be adopted. Brush cleaning type belt cleaning device 426C has brush roller 428C configured to rotate to scrape the toner on intermediate transfer belt 421. Suction type belt cleaning device 426D has suction port 429D, and brush roller 430D which is disposed in suction port 429D and configured to rotate to scrape the toner on intermediate transfer belt 421.

The invention claimed is:

1. An image forming apparatus comprising:

a transfer belt;

an image forming section configured to form a toner image on the transfer belt;

a first cleaning section configured to perform cleaning for removing toner on the transfer belt;

a second cleaning section having a cleaning performance greater than a cleaning performance of the first cleaning section, and configured to perform cleaning for removing the toner on the transfer belt at a position on an upstream side of the first cleaning section in a movement direction of the transfer belt;

a determination section configured to determine a necessity of formation of a high-coverage patch having a coverage exceeding a limit of the cleaning performance of the first cleaning section on a basis of job information relating to a print job;

an image formation control section configured to control the image forming section to form the high-coverage patch on the transfer belt when formation of the high-coverage patch is necessary; and a cleaning control section configured to control the second cleaning section to execute the cleaning at a time when the high-coverage patch on the transfer belt passes over a position of the second cleaning section.

2. The image forming apparatus according to claim 1, wherein the job information used for determination of the determination section includes information on whether a sheet used in the print job is a continuous sheet, and information on whether a coverage rate in the print job is lower than a predetermined value.

3. The image forming apparatus according to claim 1, wherein:

the high-coverage patch includes a high-coverage part having a coverage exceeding the limit of the cleaning performance of the first cleaning section, and a low-coverage part located at a front end and a rear end of the high-coverage part and having a coverage equal to or lower than the limit of the cleaning performance of the first cleaning section; and the cleaning control section starts the cleaning of the second cleaning section at a timing when the low-coverage part located at the front end passes over the position of the second cleaning section, and stops the cleaning of the second cleaning section at a timing when the low-coverage part located at the rear end passes over the position of the second cleaning section.

4. The image forming apparatus according to claim 1, wherein each of the first cleaning section and the second cleaning section includes a blade, and the blade of the second cleaning section makes contact with the transfer belt with a contact angle and/or a contact force greater than a contact angle and/or a contact force of the blade of the first cleaning section.

5. The image forming apparatus according to claim 1, wherein each of the first cleaning section and the second cleaning section includes a blade, and the blade of the second cleaning section has a width smaller than a width of the blade of the first cleaning section.

6. An image formation system comprising:

a sheet feeding apparatus configured to feed a roll sheet;

the image forming apparatus according to claim 1; and a winding apparatus configured to wind up the roll sheet on which the toner image is formed by the image forming apparatus.

7. A non-transitory computer-readable recording medium storing a program of an image forming apparatus, the image forming apparatus including:

a transfer belt;

an image forming section configured to form a toner image on the transfer belt;

a first cleaning section configured to perform cleaning for removing toner on the transfer belt; and a second cleaning section having a cleaning performance greater than a cleaning performance of the first cleaning section, and configured to perform cleaning for removing the toner on the transfer belt at a position on an upstream side of the first cleaning section in a movement direction of the transfer belt, the program being configured to cause a computer of the image forming apparatus to execute processing, the processing comprising:

determining a necessity of formation of a high-coverage patch having a coverage exceeding a limit of the cleaning performance of the first cleaning section on a basis of job information relating to a print job;

controlling the image forming section to form the high-coverage patch on the transfer belt when formation of the high-coverage patch is necessary; and controlling the second cleaning section to execute the cleaning at a time when the high-coverage patch on the transfer belt passes over a position of the second cleaning section.

8. The non-transitory computer-readable recording medium according to claim 7, wherein the job information includes information on whether a sheet used in the print job is a continuous sheet, and information on whether a coverage rate in the print job is lower than a predetermined value.

9. The non-transitory computer-readable recording medium according to claim 7, wherein:

the high-coverage patch includes a high-coverage part having a coverage exceeding the limit of the cleaning performance of the first cleaning section, and a low-coverage part located at a front end and a rear end of the high-coverage part and having a coverage equal to or lower than the limit of the cleaning performance of the first cleaning section; and the computer of the image forming apparatus is caused to execute processing including starting the cleaning of the second cleaning section at a timing when the low-coverage part located at the front end passes over the position of the second cleaning section, and stopping the cleaning of the second cleaning section at a timing when the low-coverage part located at the rear end passes over the position of the second cleaning section.

* * * * *